US009710994B2

(12) United States Patent
Omura

(10) Patent No.: US 9,710,994 B2
(45) Date of Patent: Jul. 18, 2017

(54) TABLET CASSETTE FOR TABLET FEEDER

(71) Applicant: TOSHO, INC., Tokyo (JP)

(72) Inventor: Yoshihito Omura, Tokyo (JP)

(73) Assignee: TOSHO, INC., Tokyo (JP)

( * ) Notice: Subject to any disclaimer, the term of this patent is extended or adjusted under 35 U.S.C. 154(b) by 0 days.

(21) Appl. No.: 14/901,841

(22) PCT Filed: Jul. 3, 2014

(86) PCT No.: PCT/JP2014/067747
§ 371 (c)(1),
(2) Date: Dec. 29, 2015

(87) PCT Pub. No.: WO2015/002259
PCT Pub. Date: Jan. 8, 2015

(65) Prior Publication Data

US 2016/0371916 A1 Dec. 22, 2016

(30) Foreign Application Priority Data

Jul. 3, 2013 (JP) ..... 2013-139480

(51) Int. Cl.
*B65H 3/00* (2006.01)
*G07F 11/22* (2006.01)
(Continued)

(52) U.S. Cl.
CPC ..... *G07F 17/0092* (2013.01); *B65B 35/08* (2013.01); *G07F 11/005* (2013.01); *G07F 11/44* (2013.01); *G07F 11/62* (2013.01)

(58) Field of Classification Search
CPC ... B65B 35/08; G07F 17/0092; G07F 11/005; G07F 11/44; G07F 11/62
(Continued)

(56) References Cited

U.S. PATENT DOCUMENTS 3,706,396 A * 12/1972 Knapp ..... B65G 47/1457 111/63
4,228,920 A * 10/1980 Burton ..... B65D 83/0409 221/265
(Continued)

FOREIGN PATENT DOCUMENTS

JP 2000-163554 6/2000
JP 2001-106201 4/2001
(Continued)

OTHER PUBLICATIONS

International Search Report, Date of mailing: Sep. 9, 2014 (Sep. 9, 2014).
European Search Report dated Jan. 30, 2017.

*Primary Examiner* — Rakesh Kumar
(74) *Attorney, Agent, or Firm* — Rankin, Hill & Clark LLP

(57) ABSTRACT

A tablet cassette is conveniently available for irregularly shaped or halved tablets as with regularly shaped tablets. The tablet cassette includes a fall prevention mechanism configured to prevent extra tablets from falling down into an outlet port. The fall prevention mechanism has a round belt disposed upwardly of the outlet port and at a position higher than partition portions. The fall prevention mechanism is configured to prevent extra tablets from falling such that the extra tablets locating on or above or protruding from one of the tablet receiving portions, which comes closest to the outlet port by rotation of the rotor, are pushed toward the rotor by a repulsive force generated by deformation of the round belt as caused when the extra tablets abut on the round belt.

8 Claims, 8 Drawing Sheets

(51) Int. Cl.

| | |
|---|---|
| ***G07F 11/16*** | (2006.01) |
| ***G07F 11/24*** | (2006.01) |
| ***G07F 17/00*** | (2006.01) |
| ***B65B 35/08*** | (2006.01) |
| ***G07F 11/00*** | (2006.01) |
| ***G07F 11/44*** | (2006.01) |
| ***G07F 11/62*** | (2006.01) |

(58) Field of Classification Search
USPC ..... 221/277, 82, 122, 166, 2, 265, 264, 119
See application file for complete search history.

(56) References Cited

U.S. PATENT DOCUMENTS 5,074,824 A * 12/1991 Suris ..... G07D 9/008 221/203
5,803,309 A * 9/1998 Yuyama ..... G07F 17/0092 221/27
6,394,308 B1 * 5/2002 Yuyama ..... B65G 47/1457 221/119
6,471,093 B1 10/2002 Kodama
6,600,153 B1 7/2003 Ishizuka
6,736,286 B2 * 5/2004 Hashimoto ..... B65B 5/103 221/266
6,786,356 B2 * 9/2004 Geiger ..... A47J 31/60 15/3.5
7,669,733 B2 * 3/2010 Kim ..... G07F 11/54 221/261
8,887,603 B2 * 11/2014 Yuyama ..... G07F 11/66 221/265
9,299,211 B2 * 3/2016 Yuyama ..... G07F 11/66
9,457,950 B2 * 10/2016 Yoshinori ..... G07F 11/005
2008/0029537 A1 * 2/2008 Minami ..... B65B 5/103 221/312 B
2011/0170655 A1 7/2011 Yuyama et al.
2013/0267927 A1 10/2013 Omura et al.
2014/0183208 A1 * 7/2014 Bae ..... A61J 7/0084 221/91
2015/0027286 A1 * 1/2015 Yuyama ..... G07F 11/66 83/105

FOREIGN PATENT DOCUMENTS

JP 2002006585 A * 1/2002
JP 2002-153541 5/2002
JP 2002-154637 5/2002
JP 2002154637 A * 5/2002
JP 2004-041433 2/2004
JP 2011083357 A * 4/2011
JP 2012-120719 6/2012
JP 2013-39426 2/2013
JP 2013039426 A * 2/2013 ..... G07F 11/66
KR 101467986 B1 * 12/2014

* cited by examiner

TABLET CASSETTE FOR TABLET FEEDER

TECHNICAL FIELD

The present invention relates to a tablet cassette working as a portion to be driven in a tablet feeder for automated dispensation of tablets in a hospital or pharmacy.

BACKGROUND ART

Patent Documents 1-3 disclose conventional tablet feeders. As shown in FIG. 10A-10D, for example, a typical conventional tablet feeder comprises a driving portion 10 fixed to a drawer rack or the like in a tablet dispensing apparatus for power supply and control, and a tablet cassette 20 detachably mounted on the driving portion 10 for facilitating replenishment of tablets. The tablet feeder stores a number of tablets 4 in the tablet cassette 20 at random and is configured to feed out tablets 4 one by one from the tablet cassette 20 by intermittently or continuously operating the driving portion 10 as needed.

In such tablet feeder (10, 20), the tablet cassette 20 comprises a tablet container 21 and a rotor 23. The tablet container 21 includes a bottom portion 21A and a peripheral wall portion 21B, and contains a number of tablets 4, which have been replenished by opening a lid 22, in its internal space. The rotor 23 is configured to rotate centering on its axis portion as driven by the driving portion 10 via a rotation transmission shaft 27. The rotor 23 has the rotation transmission shaft 27 which constitutes the axis portion of the rotor and rotatably penetrates the bottom wall portion 21A of the tablet container 21, and rotates centering on the rotation transmission shaft 27 (the axis portion). An upper surface of the rotor 23 is shaped to cause the tablets to align while the rotor rotates. The rotor 23 has a plurality of partition portions 25 formed on its outer peripheral portion. The partition portions 25 of the rotor 23 radially extend and are circumferentially spaced at a given interval to partition a space defined between the rotor 23 and the peripheral wall portion 21B of the tablet container 21 at an equal pitch to form a plurality of tablet receiving portions 26. An outlet port 28 is formed in the bottom wall portion 21A. A partition plate 29 is disposed upwardly of the outlet port 28 to bridge over two adjacent partition portions 25. The tablet container 21 and the rotor 23 are made of a hard material while the partition plate 29 is made of a softer material than metal or hard material not to damage the tablets 4. The partition plate 29 is disposed such that its height may be adjusted.

Such tablet cassette 20 is intended to be used for tablets, not powder medicines. Typically, a tablet cassette is used for tablets shaped in circular disc like illustrated disc-shaped tablets 4. A tablet cassette is also used for tablets shaped in regular polygon or cylindrical capsules.

In addition to tablets of regular shape such as a circle, a globe, a regular polygon and a regular polyhedron, a tablet cassette is also used for tablets of irregular shape such as a diamond, spindle-shaped tablets having an expanded central portion, and halved tablets prepared by cutting a complete tablet for doses of less than one tablet.

PRIOR ART DOCUMENTS

Patent Documents

Patent Document 1: JP 2002-153541 A
Patent Document 2: JP 2002-154637 A
Patent Document 3: JP 2012-120719 A

SUMMARY OF THE INVENTION

Technical Problem

In dealing with the tablets of irregular shape or halved tablets as mentioned above, the conventional tablet cassettes need careful adjustments and cumbersome preparations which are not required for tablets of regular shape.

FIGS. 11A and 11B show how disc-shaped tablets 4 are discharged. Specifically, assume that the tables are regularly shaped and one tablet 4 is received in each tablet receiving portion 26 formed between two partition portions 25 in the annular gap 24 which is defined between the peripheral wall portion 21B of the tablet container 21 and the rotor 23 of the tablet cassette 20. When other tablets come on the one tablet 4 received in the tablet receiving portion 26, other tablets run on the tablets received in the tablet receiving portions 26 or the partition portions 25 and do not even partially get into the tablet receiving portions 26. Therefore, even if position adjustment of the partition plate 29 is somewhat rough, the tablets 4 received in the tablet receiving portions 26 and other tablets positioned on the received tablets are vertically partitioned with ease in an appropriate manner. As a result, sequential falling and discharging of the tablets are reliably performed, and the position adjustment of the partition plate 29 is comparatively easy.

In contrast therewith, FIGS. 12A and 12B show how irregularly shaped tablets having a pointed or acuate end portion or halved tablets 8 are discharged. When such irregularly shaped or halved tablets 8 are received in the tablet receiving portions 26 in the annular gap 24, relatively large hollow spaces are likely formed in upper and lower portions of the tablet receiving portions. When a halved tablet 8 comes above the tablet receiving portion 26 in which another halved tablet 8 is already received, the lower portion of the upper tablet 8 may get into a hollow space formed in the upper portion of the tablet receiving portion 26, depending upon the posture of the upper tablet 8 which has come on or above the tablet receiving portion 26. To prevent such situation, the positioning of the partition plate 29 for vertically partitioning the upper tablets 8 from the lower tablets is limited to a narrow range. As a result, it is necessary to find out a proper position of the partition plate 29 on a trial and error basis such as experiments, thereby requiring much time and effort. In most cases, even if a proper position can be found, it is still necessary to definitely adjust the position of the partition plate 29.

Further, it is important to smooth the end portions of an irregularly shaped tablet or the cross-sectional surface of a halved tablet, considering the following situation: when the halved tablet 8 which partially has got into the tablet receiving portion 26 abuts on the partition plate 29, the halved tablet 8 should entirely get on or above the partition plate 29 to completely come out of the tablet receiving portion 26. For this purpose, it is sometimes necessary to make preparations such as selecting tablets in advance, carefully cutting the tablets, and smoothing the surfaces of the tablets.

Thus, compared with the regularly shaped tablets, it is difficult to deal with the irregularly shaped or halved tablets. For this reason, the irregularly shaped or halved tablets are rarely dealt with a fully automatic tablet cassette, and have conventionally been handled by a semi-automatic tablet dispenser or manual dispensation.

As the sort of medicines increases, however, irregularly shaped tablets also increase. Furthermore, prescription of halved tablets tends to increase from the standpoint that the dosage or the number of tablets should carefully be determined depending upon the weight and other aspects of each patient for suppression of side effects. On the other hand, the demand for automated dispensation and improved efficiency is more and more increasing.

An object of the present invention is to provide a tablet cassette for a tablet feeder that is capable of readily handling irregularly shaped or halved tablets as with regularly shaped tablets.

Solution to Problem

A tablet cassette for a tablet feeder, of which improvements the present invention aims at, comprises a tablet container, a rotor, and a plurality of partition portions. The tablet container includes a bottom wall portion having an outlet port formed therein and a peripheral wall portion, and is configured to contain a number of tablets. The rotor includes an axis portion which rotatably passes through the bottom wall portion of the tablet container. The rotor is configured to rotate centering on the axis portion and has an upper surface shaped to cause the tablets to align. The plurality of partition portions radially extend from an outer peripheral portion of the rotor and are circumferentially spaced at a given interval such that an annular gap, which is defined between the rotor and the peripheral wall portion of the tablet container, is partitioned at an equal pitch to form a plurality of tablet receiving portions. The tablet cassette of the present invention includes a fall prevention mechanism configured to prevent extra tablets from falling into an outlet port. The fall prevention mechanism includes a readily deformable elastic member or flexible member which is disposed upwardly of the outlet port and at a position higher than the partition portions. The fall prevention mechanism is configured such that one or more extra tablets locating on or above or protruding from one of the tablet receiving portions, which comes closest to the outlet port by rotation of the rotor, are pushed toward the rotor by means of a repulsive force generated by deformation of the elastic member or the flexible member when the one or more extra tablets abut on the elastic member or the flexible member. Thus, the one or more extra tablets are prevented from falling down into the outlet port.

According to the tablet cassette of the present invention, one or more extra tablets locating on or above or protruding from one tablet receiving portion are pushed toward the rotor by means of the repulsive force generated at the elastic member or the flexible member. Thus, the extra tablets can be prevented from falling down into the outlet port. This allows only the tablets received in the tablet receiving portions to fall into the outlet port to be discharged therefrom, thereby preventing the extra tablets from falling. In such situation, even if a part of an extra tablet has got into the tablet receiving portion, the major part of the extra tablet that protrudes from the tablet receiving portion is pushed toward the rotor, and the extra tablet is entirely sandwiched between the rotor and the elastic member or the flexible member. Also, the major part of the extra tablet is softly pushed up onto the rotor, thereby causing the part of the extra tablet which has got into the tablet receiving portion to get out therefrom. It is unlikely that the major part of the extra tablet that protrudes from the tablet receiving portion and the part of the extra tablet that has got into the tablet receiving portion will break up. Accordingly, even for irregularly shaped or halved tablets, there is no need of careful position adjustment of the elastic member or the flexible member and complicated preparations. With almost the same or not so different degree of adjustments and preparations as compared with the regularly shaped tablets, sequential discharging of the irregularly shaped or halved tablets can properly be performed by the tablet cassette.

Therefore, the present invention realizes a tablet cassette capable of readily handling irregularly shaped or halved tablets as with regularly shaped tablets.

The fall prevention mechanism preferably includes an endless belt and a pair of pulleys operable to rotatably support the endless belt with a tensile force being applied to the endless belt. In this configuration, the endless belt constitutes the elastic member or the flexible member. When an external force is applied to the endless belt supported by the pair of pulleys via extra tablets in a longitudinal direction or a tension direction, the endless belt lightly circulates. When one or more extra tablets staying on the tablet receiving portions or partition portions are moved along the annular gap by the rotating rotor and abut on the endless belt, the endless belt circulates or moves cyclically in association with the movement of the extra tablets. Even if the extra tablets are repelled toward the rotor by the endless belt, or the extra tablets are sandwiched between the endless belt and the rotor, the extra tablets and the endless belt do not rub strongly against each other. Thus, the tablets are less likely to be damaged than ever, thereby alleviating worries about damaged tablets.

As the endless belt, a flat belt having a flat cross-sectional shape or a round belt having a round cross-sectional belt is preferably employed. For a flat belt to be used as the endless belt, an extended outer peripheral surface is preferably provided on the outer peripheral portion of the rotor so as to circumferentially extend continuously above the partition portions to sandwich one or more extra tablets between the extended outer peripheral surface and the flat belt. When a flat belt is employed as the endless belt, a contact surface between the extra tablets and the endless belt is wide. Regardless of whether the extra tablets are repelled or sandwiched as mentioned above, the force applied to the extra tablets is distributed, thereby avoiding local concentration of the force on the extra tablets. Therefore, the flat belt gently acts on the tablets which have come into contact with the flat belt. Especially when the extra tablets are sandwiched between the flat belt and the rotor, the force applied to the extra tablets are distributed almost entirely over the major parts of the tablets, thereby enhancing gentle act of the belt on the extra tablets. Especially when the extended outer surface is provided on the peripheral portion of the rotor so as to sandwich the extra tablets between the rotor and the flat belt, most of the extra tablets are softly sandwiched between the flat belt and the rotor, and are thereby prevented from falling. As a result, risks of damaging the tablets are furthermore reduced. The sandwiched tablets are released after passing over the outlet port, and gently but swiftly enter into vacant tablet receiving portions at the outlet port. This facilitates trailing tablets to be swiftly and properly aligned.

When the endless belt is formed of a round belt, the center of the round cross-sectional shape of the round belt is preferably positioned above an upper end of the annular gap such that the round belt may repel one or more extra tablets toward the upper surface of the rotor by means of the repulsive force. In a case where a round belt is employed as the endless belt, extra tablets are directed upward when they abut on the round belt. In association with the movement of the extra tablets, the round belt is likely to be twisted. When a component force of the force of the round belt, which pushes the extra tablets toward the rotor, acts on the extra tablets upwardly, the extra tablets are likely to go up and be forced out of the annular gap even though the upward force is weak. Compared with the flat belt, when the round belt is employed, more tablets are repelled out while fewer tablets are sandwiched. When the extra tablets are repelled out and are thereby prevented from falling, many of the extra tablets are promptly repelled out before they reach above the outlet port. Compared with when the extra tablets are sandwiched, the endless bet (the round belt) is not stretched much and the time of stretching is shorter. Notably, concurrent sandwiching of the extra tablets that significantly stretches the round belt is hard to occur. In this manner, the tensile load imposed on the round belt is diminished, thereby eliminating the need of lengthening the belt and securing the durability required for the round belt. In particular, when the center of the round cross-sectional shape is positioned above the upper end of the annular gap such that the round belt may repel the extra tablets toward the upper surface of the rotor by means of the repulsive force, most of the extra tablets are repelled toward the rotor by the round belt to come on the rotor, thereby considerably alleviating the tensile load of the round belt. Accordingly, it is easy to select materials for the round belt and its support, mounting, and the like as well as shape design and compact implementation of the round belt.

When using an endless belt, a slit is formed in the peripheral wall portion of the tablet container to circumferentially extend, and the endless belt passes through the slit such that a part of the endless belt is located inside the tablet container. Preferably, the pair of pulleys are respectively disposed outside the peripheral wall portion of the tablet container and in the vicinity of both ends of the slit. With such configuration, the fall prevention mechanism can be made compact without lengthening the endless belt longer than necessary.

Further, the fall prevention mechanism is preferably constructed as a unit including a peripheral wall constituent member having the slit formed therein and constituting a part of the peripheral wall portion; a mounting structure configured to mount the pair of pulleys onto the peripheral wall constituent member; and the endless belt mounted on the pair of pulleys. Constructing the fall prevention mechanism as a unit enables easy assembling of the fall prevention mechanism and arbitrary selection of an endless belt having a cross section of any shape according to the tablet shape.

BRIEF DESCRIPTION OF DRAWINGS

FIG. 1A is a side appearance view of a tablet feeder equipped with a tablet cassette at its driving portion; FIG. 1B is a longitudinal sectional view of a tablet feeder with the tablet cassette being detached from the driving portion of the tablet feeder; FIG. 1C is a cross sectional view of a main portion of the tablet cassette; and FIG. 1D is a longitudinal sectional view of the main portion of the tablet cassette containing tablets.

FIG. 2A is a perspective view of a rotor; FIG. 2B is a perspective view of the rotor and an operational portion of an endless belt; and FIG. 2C is a perspective view showing that extra tablets is prevented from falling by the interaction of the rotor and the endless belt with the tablets.

FIG. 3A illustrates that a halved tablet is falling down to be discharged; and FIG. 3B illustrates that the partition portions and the tablet receiving portions have been moved leftward by means of rotation of the rotor.

FIG. 4A illustrates that a disc-shaped tablet is falling down to be discharged; and FIG. 4B illustrates that the partition portions and the tablet receiving portions have been moved leftward by means of rotation of the rotor.

FIG. 6A is a side appearance view of a tablet feeder equipped with a tablet cassette at its driving portion; FIG. 6B is a longitudinal sectional view of a tablet feeder with a tablet cassette being detached from the driving portion of the tablet feeder; FIG. 6C is a cross sectional view of a main portion of the tablet cassette; and FIG. 6D is a longitudinal sectional view of the main portion of the tablet cassette containing tablets.

FIG. 7A is a perspective view of a rotor and an operational portion of an endless belt; and FIG. 7B is an enlarged side view around the operational portion.

FIG. 10A is a side appearance view of a tablet feeder equipped with a tablet cassette at its driving portion; FIG. 10B is a longitudinal sectional view of a tablet feeder with the tablet cassette being detached from the driving portion of the tablet feeder; FIG. 10C is a cross sectional view of a main portion of the tablet cassette; and FIG. 10D is a longitudinal sectional view of the main portion of the tablet cassette containing tablets.

FIG. 11A illustrates that a disc-shaped tablet is falling down to be discharged; and FIG. 11B illustrates that the partition portions and the tablet receiving portions have been moved leftward by means of rotation of the rotor.

FIG. 12A illustrates that a halved tablet is falling down to be discharged; and FIG. 12B illustrates that the partition portions and the tablet receiving portions have been moved leftward by means of rotation of the rotor.

DESCRIPTION OF EMBODIMENTS

Now, embodiments of a tablet cassette for a tablet feeder according to the present invention will be described below with reference to the accompanying drawings.

FIGS. 1-4 illustrate a first embodiment of a tablet cassette for a tablet feeder according to the present invention. FIG.

Figure 11A:
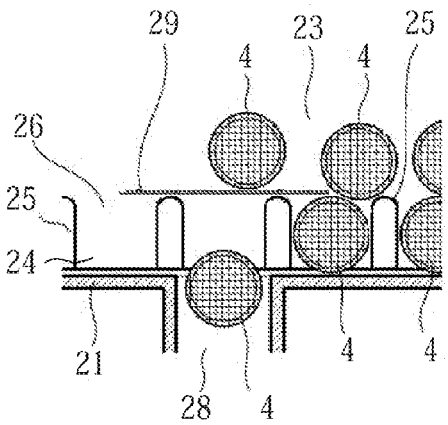
FIGS. 11A and 11B illustrate how a disc-shaped tablet is discharged from the tablet cassette containing a number of disc-shaped tablets. Individually.
Figure 11B:
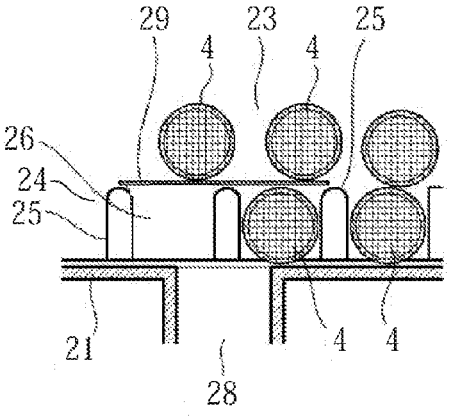
Figure 12A:
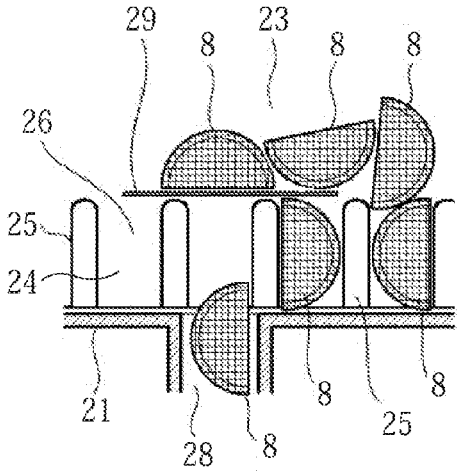
FIGS. 12A and 12B illustrate how a halved tablet is discharged from the tablet cassette containing a number of halved tablets. Individually.
Figure 12B:
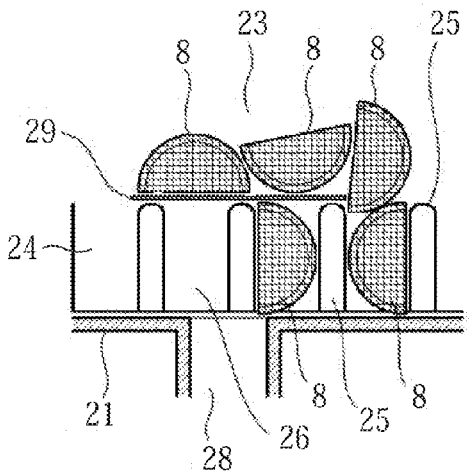

5 is a perspective view showing a fall prevention mechanism constructed as a unit usable in the first embodiment. FIGS. 6-8 illustrate a second embodiment of a tablet cassette for a tablet feeder according to the present invention. FIG. 9 is a perspective view showing a fall prevention mechanism constructed as a unit usable in the second embodiment. For simplification and clarity, FIGS. 1-4 and FIGS. 6-8 illustrate parts required for explanation of the present invention and related parts, omitting the details of other parts including fastening parts such as hinges, electric circuits such as a motor driver, and electronic circuits such as a controller. In FIGS. 1-9, parts are allocated reference numbers obtained by adding 100 or 200 to the reference numbers of the counterparts of a conventional tablet cassette for a tablet feeder illustrated in FIGS. 10-12, and the duplicated explanations of the like parts are omitted as appropriate. The following explanations of the first and second embodiments focus on differences between the present invention and the prior art.

First Embodiment

Figure 1A:
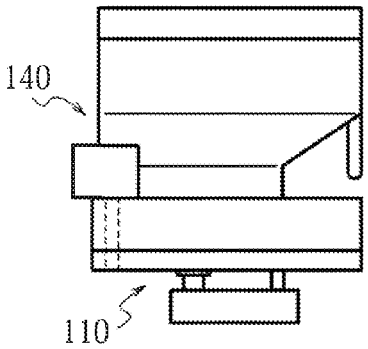
FIGS. 1A-1D illustrate the configuration of a tablet cassette according to a first embodiment of the present invention. Individually.
Figure 1B:
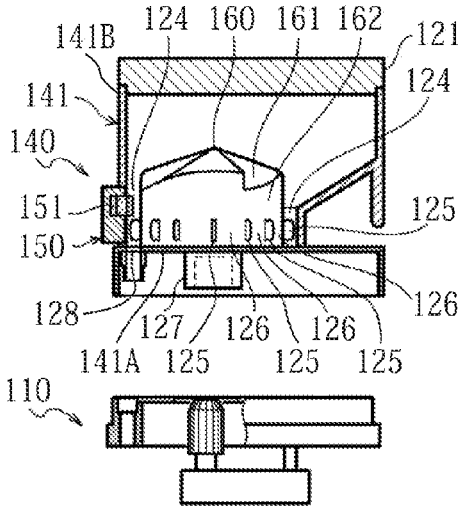
Figure 1C:
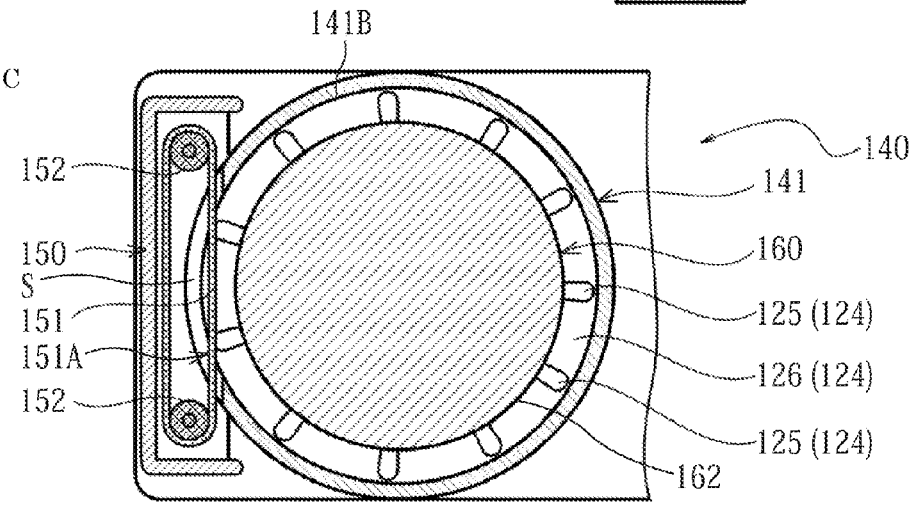
Figure 1D:
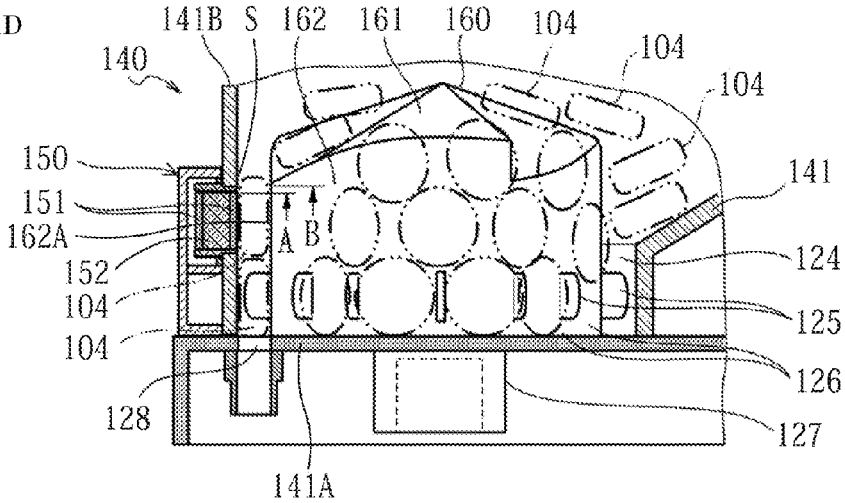

The tablet cassette for a tablet feeder according to the first embodiment of the present invention will be specifically described with referent to the accompanying drawings. FIG. 1A is a side appearance view of a tablet feeder equipped with a tablet cassette 140 at its driving portion 110. FIG. 1B is a longitudinal sectional view of a tablet feeder with a tablet cassette 140 being detached from the driving portion 110 of the tablet feeder. FIG. 1C is a cross sectional view of a main portion of the tablet cassette 140. FIG. 1D is a longitudinal sectional view of the main portion 140 of the tablet cassette containing disc-shaped tablets 104.

Figure 2A:
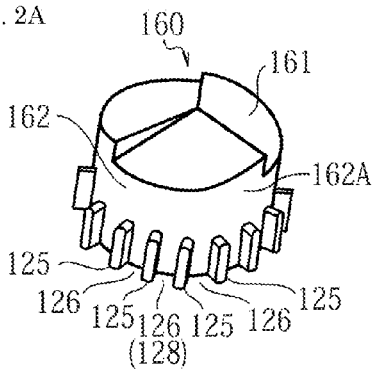
FIGS. 2A-2C illustrate the configuration of a main portion of the tablet cassette. Individually.
Figure 2B:
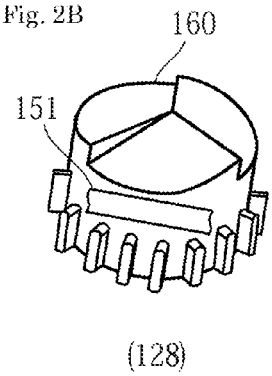
Figure 2C:
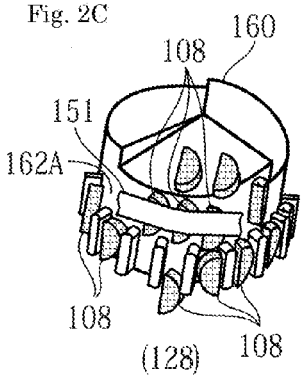

FIG. 2A is a perspective view of a rotor 160. FIG. 2B is a perspective view of the rotor 160 and an operational portion of an endless belt 151. FIG. 2C is a perspective view showing that extra halved tablets 108 are prevented from falling by the interaction of the rotor 160 and the endless belt 151 with the tablets 108.

The tablet cassette 140 of the present embodiment is different from the conventional tablet cassette 20 as illustrated in FIGS. 10A-10D in the following aspects. In the present embodiment, a fall prevention mechanism 150 including a flat endless belt 151 as a readily deformable elastic or flexible member is employed in place of the partition plate 29 and its retaining unit; a mounting portion of the tablet container 141 is modified to be combined with the fall prevention mechanism to constitute a tablet container 141; and the length of the rotor 160 as measured in its axial direction is longer than that of the conventional rotor 23.

The tablet cassette 140 of the present embodiment is the same as the conventional tablet cassette 20 illustrated in FIGS. 10A-10D in that the tablet cassette 140 can be detached from the driving portion 110 and the rotor 160 is driven to rotate by the driving portion 110 when attached to the driving portion.

The tablet cassette 140 is the same as the conventional cassette 20 in the following configuration. The tablet container 141 is capable of containing a number of tablets (104, 108), and is provided with an openable lid member 121. The rotor 160 is provided inside the tablet container 141 so as to be capable of rotating around a rotation transmission shaft 127. An upper surface 161 of the rotor 160 is inclined stepwisely so as to be suitable for stirring the tablets. Further, an annular gap 124 is defined between an outer peripheral surface 162 of the outer peripheral portion of the rotor 160 and an inner peripheral surface of a peripheral wall portion 141B of the tablet container 141. A plurality of partition portions 125 of blade shape are unitarily formed with the outer peripheral surface 162 and are circumferentially spaced at an equal pitch. The annular gap 124 is partitioned by the partition portions 125 to form a plurality of tablet receiving portions 126 at an equal pitch. An outlet port 128 is formed in a bottom wall portion 141A of the tablet container 141 at a location where a part of the bottom wall portion 141A constitutes a lower end of the annular gap 124. The tablets (104, 108) received in the tablet receiving portions 126 are sequentially discharged via the outlet port 128 by rotation of the rotor 160 around the shaft 127.

The differences between the tablet cassette 140 of the present embodiment and the conventional tablet cassette 20 will be described below in detail. The fall prevention mechanism 150 includes an endless belt 151 made of a readily deformable elastic or flexible member such as silicone rubber. For example, a flat belt having a flat cross-sectional shape or a round belt having a round cross-sectional shape may be used as the endless belt. In the present embodiment, a flat belt 151 is employed. The flat belt 151 is mounted on a pair of pulleys 152, 152 without looseness or with a light tensile load being added on the belt. For example, screws or pins, not illustrated, are used for fixedly mounting the fall prevention mechanism 150 on the tablet container 141 and enabling detachment of the flat belt 151 typically when replacing the belt. At a location of the peripheral wall portion 141B of the tablet container 141 where the fall prevention mechanism 150 is mounted, an opening is appropriately formed. A wall member included in the fall prevention mechanism 150 and partially constituting the peripheral wall portion 141B is fitted in the opening. The wall member is formed with a slit S extending circumferentially of the peripheral wall portion 141B. Then, the flat belt 151 passes through the slit S and a part of the flat belt 151 is located inside the tablet container 141. A pair of pulleys 152, 152 are disposed outside the peripheral wall portion 141B and in the vicinity of both ends of the slit S. In a situation where the fall prevention mechanism 150 is mounted on the tablet container 141, the opening is blocked by the wall member to prevent the tablets from spilling out therefrom. A part 151A of the flat belt 151 passing through the slit S enters into the tablet container 141 and faces the outer peripheral surface 162 of the rotor 160. Here, the faced part 151A and the outer peripheral surface 162 face each other with an appropriate gap therebetween. The faced part 151A of the flat belt 151 constitutes the deformable elastic or flexible member.

At least the faced part 151A of the flat belt 151 that faces the outer peripheral surface 162 of the rotor 160 is provided at a position higher than the partition portions 125. The faced part 151A is positioned upwardly of the outlet port 128 and is set up in parallel to an inner bottom surface of the bottom wall portion 141A of the tablet container 141. Here, the inner bottom surface constitutes the lower end of the annular gap 124. The pair of pulleys 152, 152 support the flat belt 151 in this manner. It suffices if the pulleys enable the flat belt 151 to lightly circulate. The pulleys are not limited to high-performance but expensive bearing type pulleys. Pulleys using slide bearings, which may be lower priced and more compact in size, may also be used. At least the faced part 151A of the flat belt 151 faces the outer peripheral surface 162 of the rotor 160. As shown in FIG. 1D, over the entire circumference of the rotor 160, the height A of an upper end of the faced part 151A is lower than the height B of the outer peripheral surface 162 of the rotor 160 that defines the annular gap 124. In other words, the height B of the outer peripheral surface is higher than the height A of the belt over the entire circumference of the rotor 160. In accordance with this, the upper surface 161 of the rotor 160 is higher than that of the conventional rotor though the shapes of both rotors are similar. Namely, the rotor 160 is taller than the conventional rotor. From a different viewpoint, the outer peripheral surface 162 of the rotor 160 is provided with an extended outer peripheral surface 162A located above the partition portions 125 and continuously extending in the circumferential direction so as to sandwich the extra tablets with the flat belt 151.

The fall prevention mechanism 150 of the present embodiment is configured as follows. The extra tablets locating on or above or protruding from one of the tablet receiving portions 126, which comes closest to the outlet port 128 by rotation of the rotor 160, are pushed toward the rotor 160 by means of a repulsive force generated by the flat belt 151 when the extra tablets abut on the flat belt 151. Thus, the extra tablets are prevented from falling into the outlet port 128.

Figure 3A:
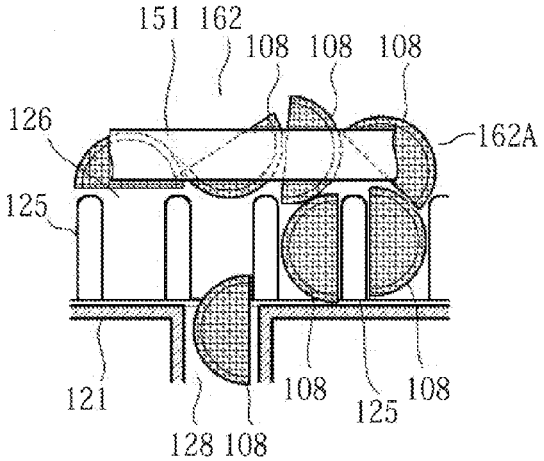
FIGS. 3A and 3B illustrate how a halved tablet is discharged from the tablet cassette containing a number of halved tablets. Individually.
Figure 3B:
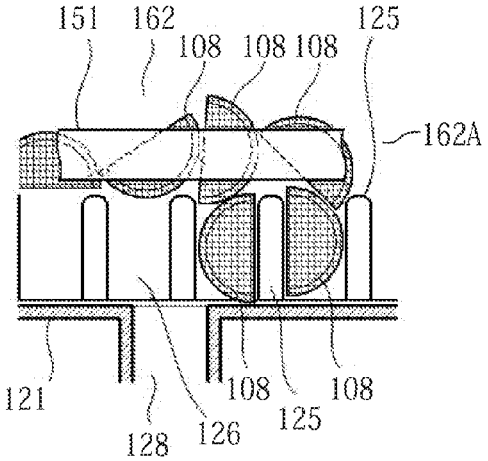
Figure 4A:
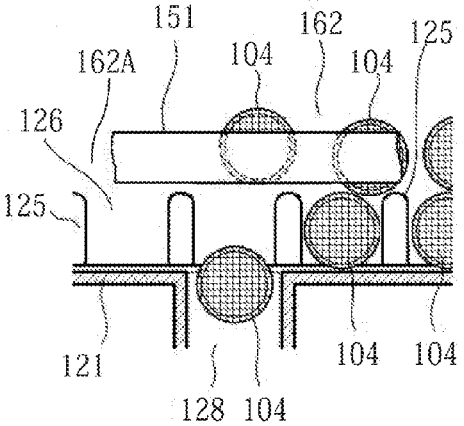
FIGS. 4A and 4B illustrate how a disc-shaped tablet is discharged from the tablet cassette containing a number of disc-shaped tablets. Individually.
Figure 4B:
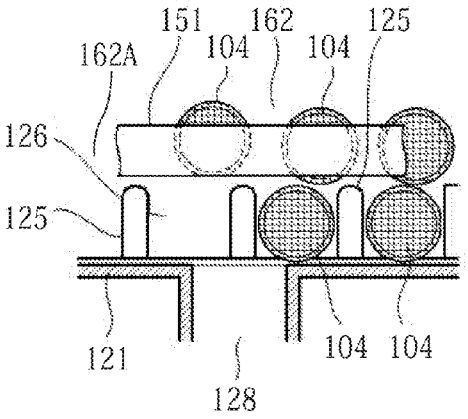

Next, the use and actions of the tablet cassette 140 of the present embodiment will be described below with reference to FIGS. 2-4. FIG. 2C is a perspective view showing that extra halved tablets 108 are prevented from falling by the interaction of the rotor 160 and the flat belt 151 with the tablets 108 above the outlet port 128. FIGS. 3A and 3*b* illustrate how a halved tablet 108 is discharged from the tablet cassette 140 containing a number of halved tablets 108. FIG. 3A illustrates that a halved tablet is falling down to be discharged. FIG. 3B illustrates that the partition portions 125 and the tablet receiving portions 126, and the halved tablets 108 have been moved leftward by means of rotation of the rotor 160. FIGS. 4A and 4B illustrate how a disc-shaped tablet 104 is discharged from the tablet cassette 140 containing a number of disc-shaped tablets 104. FIG. 4A illustrates that a disc-shaped tablet is falling down to be discharged. FIG. 4B illustrates that the partition portions 125 and the tablet receiving portions 126, and the disc-shaped tablets 104 have been moved leftward by means of rotation of the rotor 160.

In many cases, a tablet dispensing apparatus deals with various types of tablets such as disc-shaped tablets 104 and halved tablets 108, and furthermore tablets of other shapes. Taking account of storing the tablets in the tablet dispensing apparatus and utilizing common parts, it is desired that a common tablet container 141 is available for tablets of any shapes in as many cases as possible. Then, the rotor should be designed to be available for tablets of any types. Specifically, a rotor 160 to be employed should allow the tablets 104, 108 to enter into the tablet receiving portions 126 one by one by sizing each tablet receiving portion 126 slightly larger than a halved tablet 108 or a disc-shaped tablet 104.

Selection and adjustment of a fall prevention mechanism 150 should be performed in advance such that the flat belt 151 may be located upwardly of the partition portions 125. Further, a rotor 160 provided with an extended outer peripheral surface 162A should be employed such that the height B of the outer peripheral surface may be higher than the height A of the flat belt 151 over the entire circumference of the rotor.

Assume that a number of halved tablets 108 are already received in the tablet container 141 (see FIGS. 1 and 3). Once the rotor 160 rotates as driven by the driving portion 110, the halved tablets 108 which have been stirred on the upper surface 161 of the rotor 160 slide down into the annular gap 124 to be received one by one in the tablet receiving portions 126. The halved tablets 108 received in a number of the tablet receiving portions 126 are aligned in a circle, and are sequentially moved to above the outlet port 128 along with the tablet receiving portions 126, depicting a circular trajectory on the horizontal surface. Here, each of the tablet receiving portions 126 already receives one halved tablet 108. The halved tablets 108 (extra tablets) sliding down on the tablet receiving portions 126 cannot get into the tablet receiving portions 126, and stay on the tablet receiving portions 126. As a result, the extra tablets abut on the flat belt 151 before they reach above the outlet port 128. Then, the extra tablets are sequentially moved over the outlet port 128 along with the contact portions of the flat belt 151 and the outer peripheral surface 162 of the rotor 160 while causing the flat belt 151 to circulate or cyclically move (see FIG. 2*c*).

Each time one of the tablet receiving portions 126 receiving one halved tablet 108 comes above the outlet port 128 (see FIG. 3A), one halved tablet 108 falls from the tablet receiving portion 126 and is discharged out through the outlet port 128. On the other hand, even if a part of the halved tablet 108 (the extra tablet) staying on the tablet receiving portion 126 has got into the tablet receiving portion 126, the part of the extra tablet staying outside the tablet receiving portion 126 is pushed by the flat belt 151 onto the extended outer peripheral surface 162A of the outer peripheral surface 162 of the rotor 160. Then, most of the extra tablets are sandwiched between the contacting and acting portions of the flat belt 151 and the contacting portion of the extended outer peripheral surface 162A of the rotor 160. In rare cases, some extra tablets are repelled by the flat belt 151 to be returned onto the upper surface 161 of the rotor 160.

In any case, the halved tablet 108 abutting onto the flat belt 151 is retained above the tablet receiving portion 126 by the action of the flat belt 151 until it passes over the outlet port 128 even if the below-located tablet receiving portion 126 becomes empty (see FIG. 3B). Thus, it is unlikely that the extra tablets 108 fall down via the outlet port 128. After passing over the outlet port 128, the abutting portion and the contacting portion of the flat belt 151 and the outer peripheral surface 162 of the rotor 160 separate away from each other to loosen the sandwiching of the extra tablets 108. Then, the extra tablets 108 are released. The released halved tablets 108 fall down to swiftly get into the tablet receiving portions 126 (see FIG. 2C).

In this manner, like the halved tablet 108 which is located completely outside the tablet receiving portion 126, the halved tablet 108 of which a corner portion or the like has got into the tablet receiving portion 126 located below is also sandwiched and carried over the outlet port 128 or is lightly repelled onto the rotor 160. Even if the cutting surface of the halved tablet is rough or the height of the partition portions and that of the flat belt 151 are somewhat roughly determined, the halved tablets 108 are sequentially discharged rapidly and properly.

The disc-shaped tablets 104 (see FIG. 4) each have a surface the entirety of which is originally smooth since they are not cut. Therefore, they are unlikely to be caught in the tablet receiving portions 126. Furthermore, the disc-shaped tablets 104 hardly gets into the tablet receiving portions 126 when they run on the disc-shaped tablets 104 already received in the tablet receiving portions 126 since they do not have a pointed or acuate portion that is likely to get into the tablet receiving portion. Therefore, the disc-shaped tablets 104 are sequentially discharged and extra disc-shaped tablets are prevented from falling in the same manner as the halved tablets 108 as mentioned earlier. Sequential discharging and fall prevention are more stably, rapidly, and properly performed compared with the halved tablets 108.

[Fall Prevention Mechanism Unit]

Figure 5:
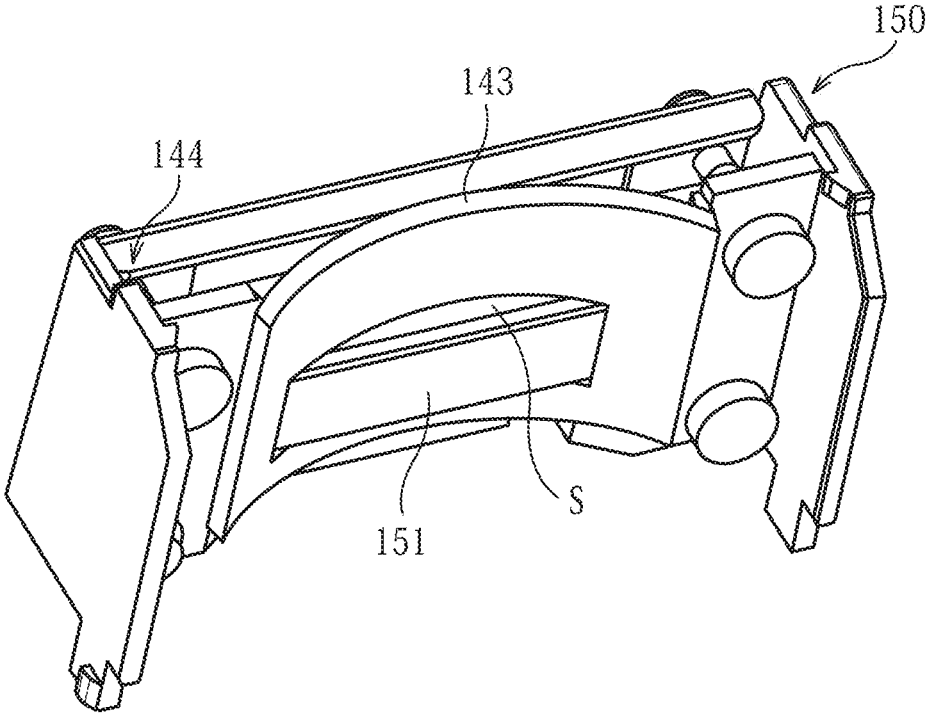
FIG. 5 is a perspective view showing an example fall prevention mechanism unit including a flat belt.

FIG. 5 is a perspective view showing an example fall prevention mechanism 150 constructed as a unit. In this example, the unit comprises a peripheral wall constituent member 143 including a wall portion constituting a part of the peripheral wall portion 141B of the tablet container 141. The peripheral wall constituent member 143 is mounted with amounting structure 144 for a pair of pulleys operable to rotatably support the flat belt 151. The peripheral wall constituent member 143 has a slit S formed therein for allowing a part of the flat belt 151 to be located inside the tablet container 141.

Second Embodiment

Figure 6A:
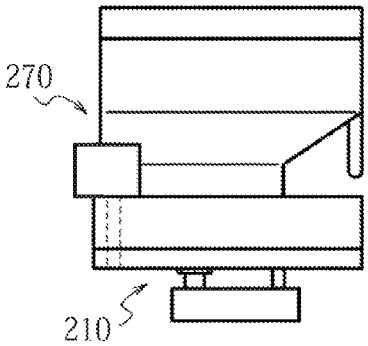
FIGS. 6A-6D illustrate the configuration of a tablet cassette according to a second embodiment of the present invention. Individually.
Figure 6B:
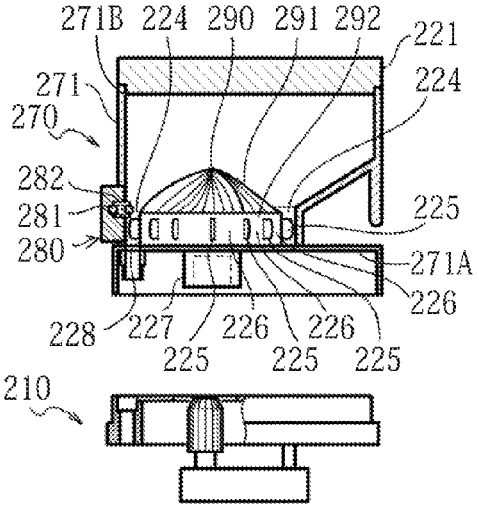
Figure 6C:
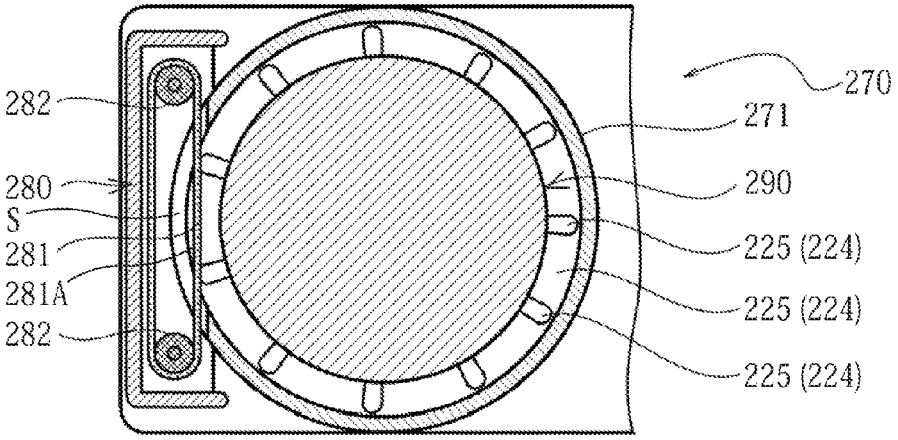
Figure 6D:
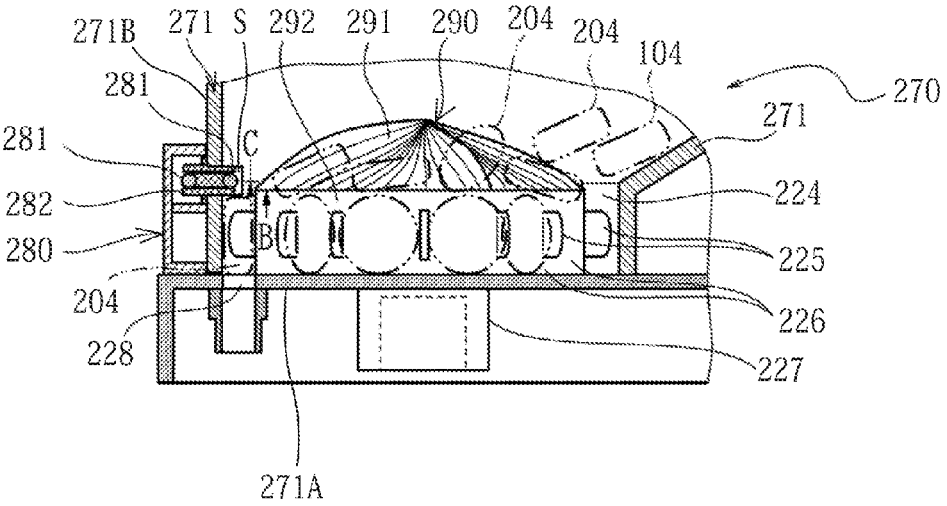

The tablet cassette for a tablet feeder according to the second embodiment of the present invention will be specifically described with referent to the accompanying drawings. FIG. 6A is a side appearance view of a tablet feeder equipped with a tablet cassette 270 at its driving portion 210. FIG. 6B is a longitudinal sectional view of a tablet feeder with a tablet cassette 270 being detached from the driving portion 210. FIG. 6C is a cross sectional view of a main portion of the tablet cassette 270. FIG. 6D is a longitudinal sectional view of the main portion of the tablet cassette 270 containing disc-shaped tablets 204.

Figure 7A:
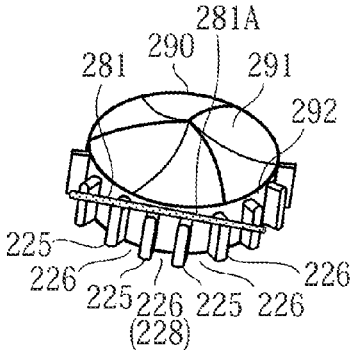
FIGS. 7A and 7B illustrate the configuration of a main portion of the tablet cassette. Individually.
Figure 7B:
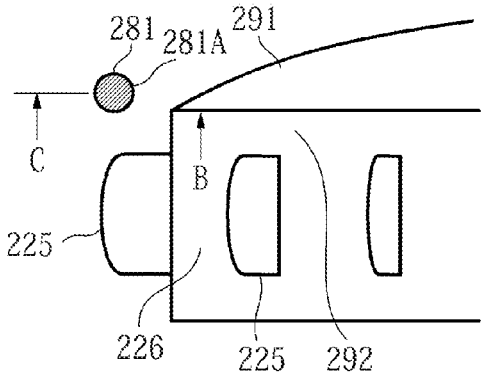

FIGS. 7A and 7B illustrate the configuration of the main portion of the tablet cassette. FIG. 7A is a perspective view of the rotor 290 and an operational portion of a round belt 281 (an endless belt). FIG. 7B is an enlarged side view around the operational portion.

The tablet cassette 270 is different from the tablet cassette 140 of the first embodiment as mentioned above in the structure of the fall prevention mechanism 280 and that of the rotor 290.

The rotor 290 of the present embodiment is different from the rotor 160 of the first embodiment in the following aspects. The rotor 290 has an outer peripheral surface 292 which defines an annular gap 224 between the outer peripheral surface 292 and a peripheral wall portion 271B of a tablet container 271. The height B of the outer peripheral surface 292 is lowered to slightly above the partition portions 225. The height B is lower than that of the outer peripheral surface 162 of the rotor 160 of the first embodiment. Namely, the rotor 290 does not include an extended outer peripheral surface. Further, the height B of the outer peripheral surface 292 is substantially constant over the entire circumference of the rotor 290. Furthermore, an upper surface 291 of the rotor 290 is inclined such that surface level difference for stirring the tablets is large in the middle of the inclined surface and is small at upper and lower ends of the inclined surface.

The fall prevention mechanism 280 is different from the fall prevention mechanism 150 of the first embodiment in that a round belt 281 is employed as an endless belt in place of the flat belt 151 and that a pair of pulleys 282 suitable for the round belt are employed.

Likewise, the differences between the tablet container 271 and the tablet container 141 of the first embodiment are due to the employment of the round belt 281 as an endless belt in place of the flat belt 151. Namely, a slit S formed in the fall prevention mechanism 280 is shaped such that an allowance for belt insertion is narrowed to be fit for the round belt 281.

As to the positional relationship of the round belt 281 and the rotor 290, as shown in FIG. 7B, the height B of the outer peripheral surface 292 of the rotor 290 that defines the annular gap 224 is lower than the height C, at which the center of the round belt 281 is located, over the entire circumference of the rotor 290. In other words, the round belt 281 is disposed at a location where the height C of the center of the round belt 281 is higher than the height B of the outer peripheral surface of the rotor 290. Further, from a different viewpoint, the center of the round cross-sectional shape is positioned above an upper end of the annular gap 224 such that the round belt 281 may repel the extra tablets toward the upper surface of the rotor 290 by means of the repulsive force. In this configuration, a faced part 281A of the round belt 281, which faces the rotor 290, does not oppose the rotor 290 face-to-face but faces the rotor as if the round belt 281 diagonally looks down on the rotor 290 from a slight higher position. As a result, the faced part 281A is in a situation as if it is floating up or has floated up from the annular gap 224.

In a case where the round belt 281 is employed, when the extra tablets staying on the tablet receiving portions 226 which already contain the tablets abut on the round belt 281, the extra tablets are slightly going up. In association with the movements of the extra tablets, the faced part 281A of the round belt 281 becomes likely to be twisted. Then, when the round belt 281 acts on the extra tablets upwardly with a component force of the force of the round belt 281 which pushes the extra tablets toward the rotor 290, the extra tablets are likely to go up to be forced out of the annular gap 224 even though the upward force is weak. In particular when the center of the round cross-sectional shape is positioned above the upper end of the annular gap 224 such that the round belt 281 may repel the extra tablets toward the upper surface of the rotor 290 by means of the repulsive force, most of the extra tablets are repelled onto the rotor 290 by the round belt 281. Thus, the tensile load imposed on the round belt 281 is significantly alleviated. This facilitates the material selection of the round belt 281, material selection of a support and mounting structure or the like for the round belt, belt shape design, and compact implementation of the belt.

Next, the use and actions of the tablet cassette 270 of the second embodiment will be described below with reference to the drawings. FIGS. 8A-8D are each an enlarged view showing that extra tablets 208 are prevented from falling by means of the interaction of the rotor 290 and the round belt 281 (the endless belt) with the extra tablets 208.

Since the basic motions of the tablet cassette 270 such as sequential discharging of the tablets by rotation of the rotor 290 and prevention of the extra tablets from falling by the round belt 281 are similar to those of the first embodiment, duplicate and redundant explanations are omitted. Also in the present embodiments, the tablet cassette 270 replenished with halved tablets 208 is mounted on the driving portion 210. The differences from the first embodiment are: the round belt 281 is employed as an endless belt; the height B of the outer peripheral surface 292 of the rotor 290 is lower than the height C of the center of the round belt 281; and thus the extra halved tablets 208 are prevented from falling by means of the cooperation of the round belt 281 and the rotor 290 in such a manner as is changed from the first embodiment according to the change in height. Some examples are illustrated (see FIGS. 8A-8D).

In the present embodiment, when the rotor 290 rotates as driven by the driving portion 210, the halved tablets 208 which have been stirred on the upper surface 291 of the rotor 290 slide down into the annular gap 224 from the upper surface 291 and are received one by one in the tablet receiving portions 226. Then, they are sequentially moved to above the outlet port 228. The extra halved tablets 208 falling down onto the tablet receiving portions 226 already containing the halved tablets 208 do not get into the tablet receiving portions 226 but stay there. These extra tablets 208 abut on the round belt 281 before they are moved to above the outlet port 228. They are urged to proceed further while causing the round belt 281 to circulate.

However, when the pointed or acuate portions of the extra halved tablets 208 have got in the tablet receiving portions located below (see FIG. 8A), the cutting surfaces of the extra halved tablets 208 abut on the round belt 281, slightly running on the belt. The extra halved tablets 208 are slightly lifted up and repelled toward the upper surface 291 of the rotor 290 by the repulsive force of the round belt 281 acting on the central portions of the extra halved tablets 208. Thus, the extra halved tablets 208 are pushed up onto the upper surface 291 of the rotor 290. In association with the movement of the extra halved tablets, the pointed or acuate portions of the extra halved tablets 208 which have got in the tablet receiving portions 226 get out therefrom. Then, the halve tablets 208 are smoothly caused to pass over the outlet port 228 without an excessive force being added on the pointed or acuate portions of the halved tablets 208 and the contacting portions of the round belt 281. Thus, the extra halved tablets 208 are prevented from falling into the outlet port 228. This also applies when not the cutting surfaces but the circular surfaces of the halved tablets 208 abut on the round belt 281.

Further, when the pointed or acuate portions of the extra halved tablets 208 do not get in the tablet receiving portions 226 (see FIG. 8B), the extra halved tablets 208 are more lightly and smoothly repelled by the round belt 281. This is because the portions of the respective circumferences of the tablets that get in the tablet receiving portions 226 are very small as with the disc-shaped tablets 204.

When the extra halved tablets 208 completely do not get in the tablet receiving portions 226 (see FIG. 8C), the halved tablets 208 are caused to stay on the upper surface 291 of the rotor 290.

Figure 8A:
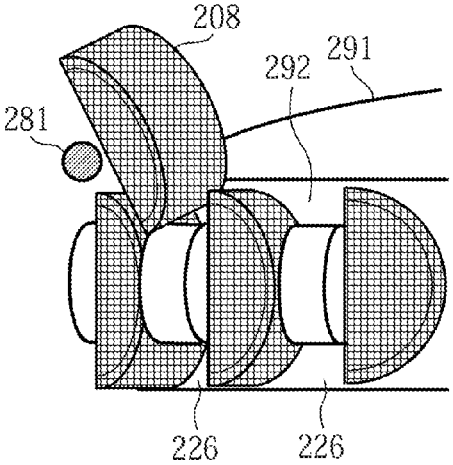
FIGS. 8A-8D are each an enlarged view showing that extra tablets are prevented from falling by means of the interaction of the rotor and the endless belt with the tablets.
Figure 8B:
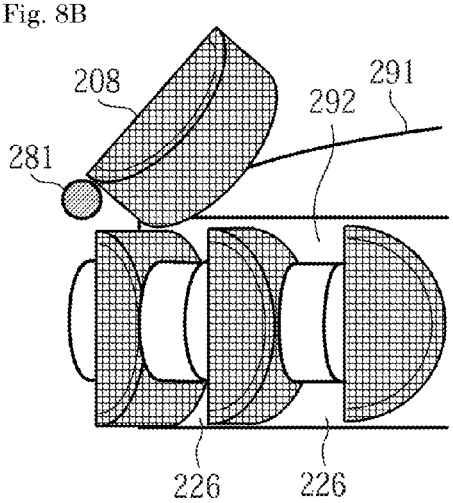
Figure 8C:
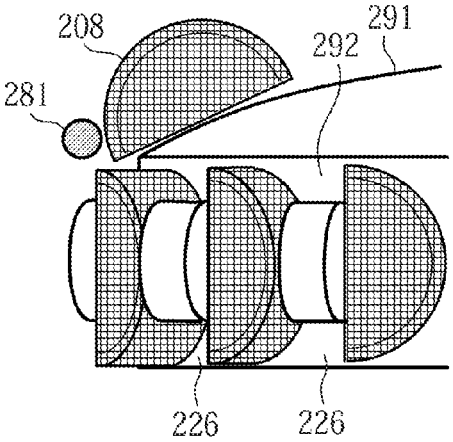
Figure 8D:
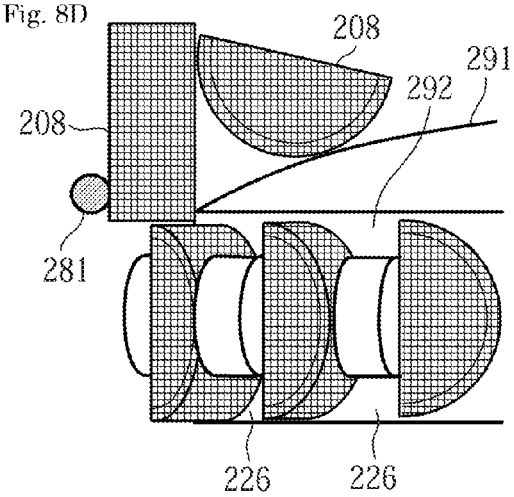
Figure 9:
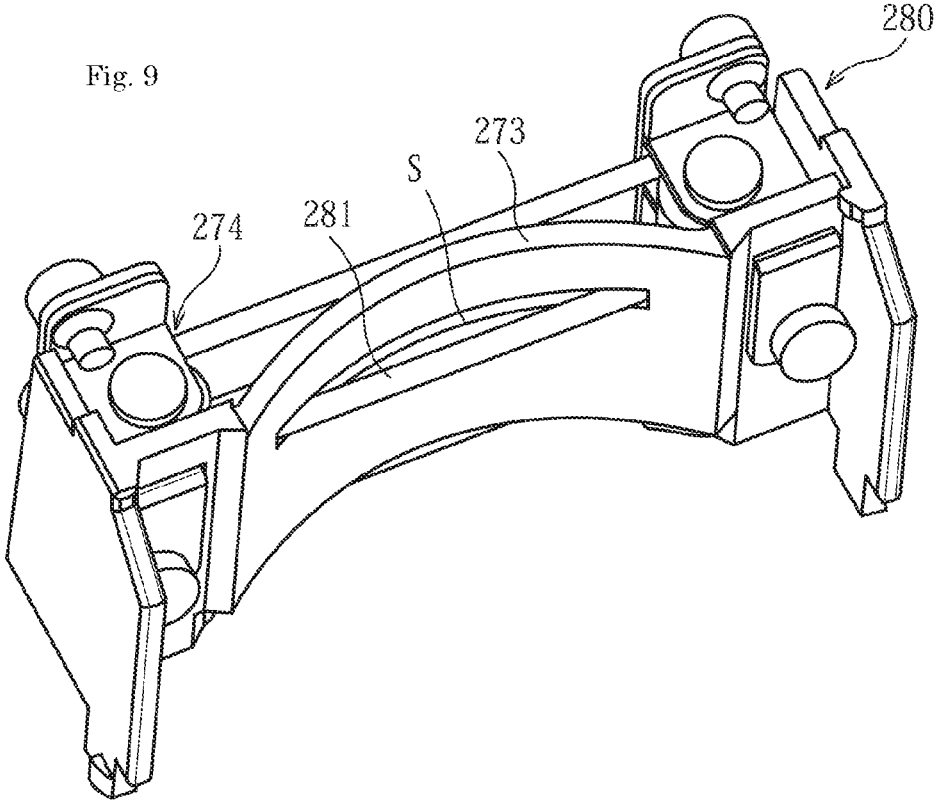
FIG. 9 is perspective view showing an example fall prevention mechanism unit including a round belt.
Figure 10A:
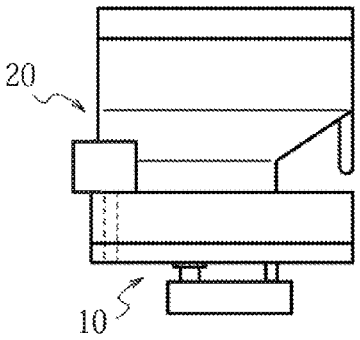
FIGS. 10A-10D illustrate a tablet feeder equipped with a conventional tablet cassette. Individually.
Figure 10B:
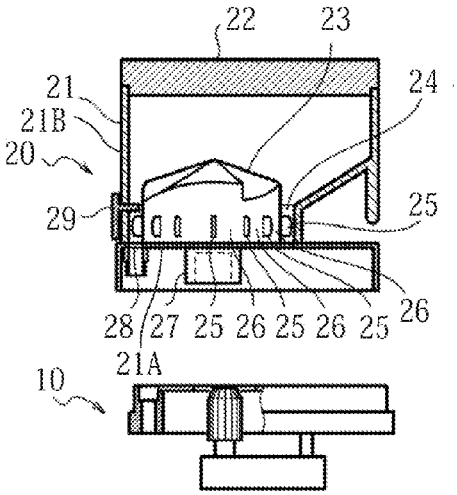
Figure 10C:
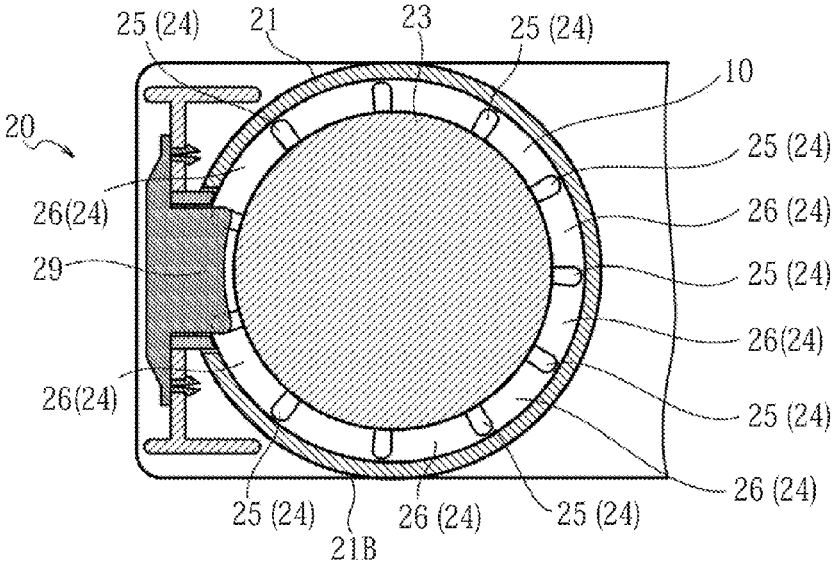
Figure 10D:
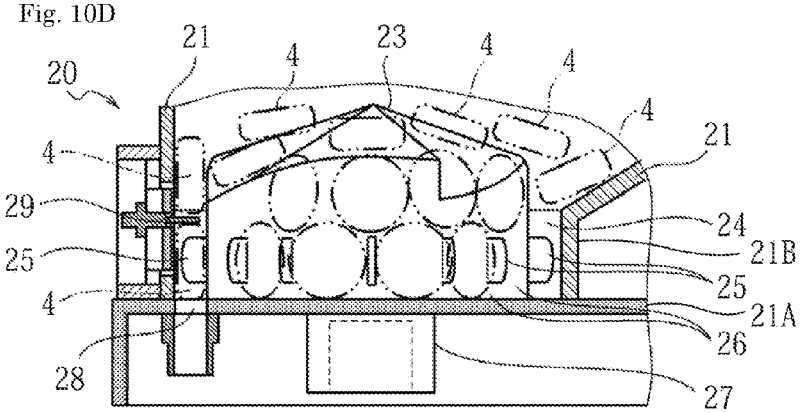

If pushing up the extra halved tablets 208, which stay on the tablet receiving portions 226, onto the upper surface 291 of the rotor 290 is hindered by other halved tablets 208, the halved tablets 208 are caused to stay between the round belt 281 and the outer peripheral surface 292 of the rotor 290 (see FIG. 8D). Even in this situation, the extra halved tablets 208 are gently carried, being sandwiched therebetween.

As described so far, in any case, the extra halved tablets 208 are properly prevented from falling.

[Fall Prevention Mechanism Unit]

FIG. 9 is perspective view showing an example fall prevention mechanism 280 as constructed as a unit. In this configuration, the unit comprises a peripheral wall constituent member 273 including a wall portion constituting a part of the peripheral wall portion 271B of the tablet container 271. The peripheral wall constituent member 273 is mounted with a mounting structure 274 for a pair of pulleys operable to rotatably support the round belt 281. The peripheral wall constituent member 273 has a slit S formed therein for positioning a part of the round belt 281 inside the tablet container 271.

[Others]

In the first and second embodiments as described so far, the tablet cassettes 140 and 270 respectively constitute a detachable portion and are manually mounted on the fixed driving portions 110 and 210 respectively to construct a tablet feeder. The coupling of the tablet cassette and the driving portion is not limited to the embodiments described herein. For example, not only the tablet cassette but also the driving portion may be movable or portable. Association of the tablet cassette with the driving portion and attachment/detachment thereof may be automated. Further, the tablet cassette may be fixedly mounted on the driving portion to configure a unitary tablet feeder.

In the first and second embodiments as described so far, only one pair of pulleys 152, 282 are employed. For example, the endless belt 151, 281 may be set up in a different manner for lengthening the belt. In this case, three or more pulleys 152, 282 may be required. Further, for increasing the stretching performance and the life of the endless belt, the pulleys 152, 282 may be supported by metallic springs and may be movable appropriately depending on the tensile force of the belt.

Further in the first and second embodiments, the rotors 160 and 290 having a different height B of the outer peripheral surface are employed. If it is not required that the percentage of sandwiching and repulsion of the tablets by the endless belt 151, 281 should be biased in a particular direction, the conventional rotor 23 may be used. In this case, either of the flat belt 151 and the round belt 281 may be used as an endless belt. Or, a belt of a different shape, for example, having a cross sectional shape of an ellipse or parallelogram may be employed. Further, if the endless belt 151, 281 and the fall prevention mechanism 150, 280 can be adapted for a retaining portion for the conventional partition plate 29 and both of them may be made compatible with each other, the conventional tablet container 21 and the conventional rotor 23 may be used.

INDUSTRIAL APPLICABILITY

The tablet cassette of the present invention may be employed in a medicine dispensing apparatus in which a number of driving portions are incorporated into a storage or the like (as disclosed, for example, in Patent Documents 1 and 2) and may also be employed in a tablet cutting apparatus in which only one driving portion is installed (as disclosed, for example, in JP2011-83357A). If the cassette is detachable, one tablet cassette may commonly be used with some driving portions by re-mounting the tablet cassette. Alternatively, some tablet cassettes may be mounted on one driving portion by replacing the tablet cassettes.

Most of the regularly and irregularly shaped tablets are intermediate between disc-shaped tablets and halved tablets. Therefore, the tablet cassette of the present invention is available for the tablets of various shapes without problems.

REFERENCE SIGN LISTING

4, 104, 204 Disc-shaped tablet (Tablet)
8, 108, 208 Halved tablet (Tablet)
10, 110, 210 Driving portion (Tablet feeder)
20 Tablet cassette (Tablet feeder)
21 tablet container
22 Lid
23 Rotor
24, 124, 224 Annular gap
25, 125, 225 Partition portion
26, 126, 226 Tablet receiving portion
27 Rotation transmission shaft
28, 128, 228 Outlet port
29 Partition plate
140 Tablet cassette
141 Tablet container
150 Fall prevention mechanism

151 Flat belt (Endless belt)
152 Pulley
160 Rotor
161 Upper surface (Stirring surface)
162 Outer peripheral surface
270 Tablet cassette
271 Tablet container
280 Fall prevention mechanism
281 Round belt (Endless belt)
282 Pulley
290 Rotor
291 Upper surface (Stirring surface)
292 Outer peripheral surface

The invention claimed is:

1. A tablet cassette for a tablet feeder comprising:

a tablet container configured to contain a number of tablets and including a bottom wall portion having an outlet port formed therein and a peripheral wall portion;

a rotor including an axis portion rotatably passing through the bottom wall portion of the tablet container and configured to rotate centering on the axis portion, wherein an upper surface of the rotor is shaped to cause the tablets to align;

a plurality of partition portions radially extending from an outer peripheral portion of the rotor and circumferentially spaced at a given interval such that an annular gap defined between the rotor and the peripheral wall portion of the tablet container is partitioned at an equal pitch to form a plurality of tablet receiving portions; and a fall prevention mechanism including a readily deformable elastic member or flexible member disposed above the outlet port and at a position higher than the partition portions, and configured such that one or more extra tablets locating on or above one of the tablet receiving portions, which comes closest to the outlet port by rotation of the rotor, are pushed toward the rotor by means of a repulsive force generated by deformation of the elastic member or the flexible member when the one or more extra tablets abut on the elastic member or the flexible member, thereby to prevent the one or more extra tablets from falling down into the outlet port;

the fall prevention mechanism includes an endless belt and a pair of pulleys operable to rotatably support the endless belt with a tensile force being applied to the endless belt; and the endless belt constitutes the elastic member or the flexible member.

2. The tablet cassette for a tablet feeder according to claim 1, wherein:

the endless belt is a round belt having a round cross-sectional shape; and the center of the round cross-sectional shape is positioned above an upper end of the annular gap such that the round belt may repel the one or more extra tablets toward the upper surface of the rotor by means of the repulsive force.

3. The tablet cassette for a tablet feeder according to claim 1, wherein:

the endless belt is a flat belt having a flat cross-sectional shape; and an extended outer peripheral surface is provided on the outer peripheral portion of the rotor and circumferentially extends continuously above the partition portions to sandwich the one or more extra tablets between the extended outer peripheral surface and the flat belt.

4. The tablet cassette for a tablet feeder according to claim 1, wherein:

a slit is formed in the peripheral wall portion of the tablet container, said slit extending around a circumference of said peripheral wall portion of the tablet container;

the endless belt passes through the slit such that a part of the endless belt is located inside the tablet container; and the pair of pulleys are respectively disposed outside the peripheral wall portion of the tablet container and in a vicinity of both ends of the slit.

5. The tablet cassette for a tablet feeder according to claim 4, wherein the fall prevention mechanism is constructed as a unit including:

a peripheral wall constituent member having the slit and constituting a part of the peripheral wall portion;

a mounting structure configured to mount the pair of pulleys onto the peripheral wall constituent member; and the endless belt mounted on the pair of pulleys.

6. The tablet cassette for a tablet feeder according to claim 1, wherein the endless belt is a flat belt having a flat cross-sectional shape or a round belt having a round cross-sectional shape.

7. The tablet cassette for a tablet feeder according to claim 6, wherein:

a slit is formed in the peripheral wall portion of the tablet container, said slit extending around a circumference of said peripheral wall portion of the tablet container;

the endless belt passes through the slit such that a part of the endless belt is located inside the tablet container; and the pair of pulleys are respectively disposed outside the peripheral wall portion of the tablet container and in a vicinity of both ends of the slit.

8. The tablet cassette for a tablet feeder according to claim 7, wherein the fall prevention mechanism is constructed as a unit including:

a peripheral wall constituent member having the slit and constituting a part of the peripheral wall portion;

a mounting structure configured to mount the pair of pulleys onto the peripheral wall constituent member; and the endless belt mounted on the pair of pulleys.

* * * * *